United States Patent [19]

Dersher

[11] 4,402,509

[45] Sep. 6, 1983

[54] DICE THROWING CRAPS GAME COMPUTER

[76] Inventor: Charles L. Dersher, P.O. Box 7172, Toledo, Ohio 43615

[21] Appl. No.: 361,877

[22] Filed: Mar. 25, 1982

[51] Int. Cl.[3] ..... G06C 3/00; G09F 9/00

[52] U.S. Cl. ..... 273/148 R; 235/88 G

[58] Field of Search ..... 235/88 R, 88 G; 273/148 R; 434/404

[56] References Cited

U.S. PATENT DOCUMENTS

| | | | |
|---|---|---|---|
| 1,989,180 | 1/1935 | Wilson | 434/404 |
| 3,058,653 | 10/1962 | Des Granges | 235/88 R |
| 3,210,866 | 10/1965 | Brunelle | 434/404 |
| 4,027,884 | 6/1977 | Oakley | 273/148 R |
| 4,369,357 | 1/1983 | Williams | 235/88 G X |

*Primary Examiner*—Harland S. Skogquist

*Attorney, Agent, or Firm*—J. Gibson Semmes

[57] ABSTRACT

A calculator to aid in determining cyclic trends of probability inherent in craps playing functions and thereby increase the potential of winning and decrease the threat of losing is disclosed. A first circular relatively stationary frame disc is attached to a second and larger circular sliding disc at their respective centers. The front face of the first circular disc has an indicator thereon and viewing windows therethrough with identifying indicia lying adjacent to each window. The windows are formed into window groupings corresponding to the selected craps playing function. The second circular sliding disc has printed thereon a plurality of carefully disposed scales, each corresponding to information needed for a particular craps playing function. The first of said scales appears along the rim of the sliding disc. When an indicator on the stationary frame disc is aligned with selected points on the rim scale of the sliding disc, selected other scales on the sliding disc disposed radially inwardly of the rim scale align with the window groupings of the stationary disc so as to indicate by numbers appearing in the windows, the numerical values of specific crap playing trends. The numbers displayed in the window groupings provide exact information to the craps player to assist in calculated wagering in accordance with the laws of cyclic probability, and random selection.

4 Claims, 4 Drawing Figures

DICE THROWING CRAPS GAME COMPUTER

BACKGROUND OF INVENTION

1. Field of Invention

My invention relates generally to a circular sliding scale-type of calculator. More specifically, this invention relates to a slide calculator of the type wherein a rotatable circular, sliding member or disc has printed thereon a plurality of numerical scales which can be viewed through a plurality of windows in a relatively stationary circular frame member or disc. The scales disclose numerical values of various craps betting options and aid the dice player in systematically analyzing the flow of the game and deciding his next prudent wager.

2. Description of the Prior Art

Many gamblers are familiar with the game of dice throwing Craps. In essence, the game relies on the laws of probability governing the result of each throw of a pair of dice. Since there are six sides on each die, there are 36 (6×6) possible different combinations from one roll. Based on a study of the possible number combinations, it may be seen that the following Table 1, entitled POSSIBILITIES (TRUE ODDS) illustrates the possible number combinations and odds that exist when throwing a pair of dice. Table 2 gives the odds that a shooter will throw a 7 before he throws his shooter's point, so to speak.

TABLE 1

POSSIBILITIES (TRUE ODDS)

| Nos. | Possible Combination that Makes the No. | No. Ways to Make the No. | Odds of Making No. on One Roll |
|---|---|---|---|
| 2 | 1&1 | 1 | 35 to 1 |
| 3 | 2&1,1&2 | 2 | 17 to 1 |
| 4 | 1&3,3&1,2&2 | 3 | 11 to 1 |
| 5 | 1&4,4&1,2&3,3&2 | 4 | 8 to 1 |
| 6 | 1&5,5&1,2&4,4&2,3&3 | 5 | 6 1/5 to 1 |
| 7 | 1&6,6&1,2&5,5&2,3&4,4-&3 | 6 | 5 to 1 |
| 8 | 2&6,6&2,3&5,5&3,4&4 | 5 | 6 1/5 to 1 |
| 9 | 3&6,6&3,4&5,5&4 | 4 | 8 to 1 |
| 10 | 4&6,6&4,5&5 | 3 | 11 to 1 |
| 11 | 5&6,6&5 | 2 | 17 to 1 |
| 12 | 6&6 | 1 | 35 to 1 |

TABLE 2

Odds that the shooter will throw a 7 before he throws his shooter's point.

| Shooter's Point | Odds |
|---|---|
| 4 | 2 to 1 |
| 5 | 3 to 2 |
| 6 | 6 to 5 |
| 7 | |
| 8 | 6 to 5 |
| 9 | 3 to 2 |
| 10 | 2 to 1 |

There are eight (8) basic areas of play: Pass Line, Don't Pass Line, Field, Big 6 & 8, Come, Don't Come, Place, Center or Hardway Bets, and Single or Double Odds.

The House or Casino percentage of advantage against the players ranges from a low of 0.6% to a high of 16.67%.

My invention encompasses the three (3) areas of betting which afford the least percentage of advantage to the House or Casino, and at the same time takes advantage of cyclic probability which is inherent in all games of chance.

One person at a time holds the dice and throws them, and this player is called the shooter. While the shooter is rolling the dice, all other bettors are affected. When they bet on the basic game, they are betting either with or against the dice, and it is what the shooter rolls that determines whether they win or lose their individual wagers.

This invention utilizes the Pass Line, Place and Free Odds bets at two (2) concurrently running levels of betting which afford the player the best possible advantage when winning, and prevents a bankroll disaster when losing.

The come-out roll is the most important roll in the game of Craps. A come-out roll occurs whenever a point has not yet been established. This can occur under the following conditions:

1. A new shooter is given the dice and has not yet made the first throw. The shooter is said to be "coming out" and the first roll is a "come out" roll.

2. When a shooter has rolled a seven (7) before repeating the established point number. The shooter is said to have "sevened-out," and his or her shoot is at an end. The next roll of the dice by a new shooter is a come-out roll.

3. A shooter has rolled a seven (7) or eleven (11) on the first throw of the dice, or on a previous come-out roll. A seven (7) or eleven (11) is a winner on the pass line, and the shooter now has a new come-out roll.

4. When a shooter on the initial or come-out roll throws a 2,3, or 12. These rolls are immediate losers for the pass line bettor and the shooter is said to have "crapped out." After this throw, a new come-out roll occurs.

5. When a shooter has rolled a point number (4,5,6,8,9, or 10) in the previous come-out roll and repeats the number before rolling a seven (7). This is a win for a pass line bettor, and after the point has repeated, there is a new come-out roll.

The line bets are the basic wagers of casino craps, and the winning and losing of these wagers often determine the results of other bets made by players on the craps table. A line bet can be made only before the come-out roll, and sometimes this bet may be won or lost on the come-out. However, many times the result of the line bet is not decided until the dice have been thrown a number of times, which is called a run.

The pass line bet can be made only before the come-out roll by placing the chip or chips in the area marked "pass line." The pass line is also known as the "front line".

A pass line bettor wins under the following circumstances:

1. The shooter on the come-out roll throws a seven (7) or eleven (11).

2. The shooter on the come-out roll throws a point number (4,5,6,8,9, or 10) and repeats the point number before rolling a seven (7).

It is the come-out roll that determines the point for pass-line bettors, and once that point is established, only that number and the seven (7) concern the pass line bettors.

The following are losing rolls for pass line bettors:

1. The shooter on the come-out roll throws a 2,3, or 12, all known as "craps". The shooter is said to have "crapped out" and all pass line bets lose, but the dice are retained by the shooter.

2. The shooter, having established a point (4,5,6,8,9, or 10) on the come-out roll, rolls a seven (7) before repeating the point.

To summarize the pass line bet. It wins if:

1. A seven (7) or eleven (11) is thrown on the come-out roll.

2. A point number is rolled on the come-out and repeats before a seven (7) is thrown.

It loses if:

1. A 2,3, or 12 is rolled on the come-out roll.

2. A point number is made on the come-out roll, but a seven (7) comes up on the dice before the point is repeated.

A pass line bet, once made by a player, cannot be removed or reduced.

Place numbers are the same as point numbers: 4,5,6,8,9, and 10. They may be bet individually, in groups, or all at once by any player. When a player makes a place bet on one or more of these numbers, they are betting the number or numbers will come up before the shooter sevens-out. These bets are off on the come-out roll, and are working, or on, only after a point has been established. Betting the place numbers is the fastest way to maximize profits at the craps table. Another great advantage of place bets, which does not change the odds or the house advantage, is that these wagers can be removed, reduced, or increased at any time prior to the next roll of the dice. When these bets are increased, they are "pressed". When these bets are removed, they are "taken down".

My invention only relates to the six (6) and eight (8) place numbers which afford the least percentage favor (1.52%) to the House. It guides the player systematically and logically in increasing and decreasing these bets to maximize profits during long runs of the dice, and reduce losses during short runs of the dice. It accomplishes this by transforming subtle trends into numerical values, thereby enhancing a player's potential of winning against a potential of bankroll disaster.

The free-odds bet is the most important bet a player can make at the casino craps table. A free-odds bet may be made by any line bettor. It is the only bet in the game of casino craps where the House has no advantage or edge over the player.

After making the pass line bet and a point has been established, the player can make a free-odds bet in an amount less than, equal to, or, in some instances, greater than the pass line bet. When this free-odds bet is made, the House pays the winner in accordance with the correct odds against the number repeating before the seven (7) shows on the dice.

When the House permits an amount equal to the line bet to be wagered as a free-odds bet, it is permitting (single odds) to be taken by the pass line bettor. When the Casino allows double to the line bet to be made as a free-odds bet, it is permitting (double odds) to be taken.

With these mathematical possibilities in mind, and with the right of the bettor to select the time, place, and amount of his bet, it is possible to calculate the numerical combinations on the types of betting mentioned,, i.e., Line, Place and Odds; which would maximize the bettor's potential of winning. In addition, by using the calculator scales of this invention, grouped under the items Down 1,2, and Press 1, 1+L, 2 and 2+L, it is possible for a bettor to know when it is adviseable and advantageous to increase or decrease his betting levels for each of these playing functions. Rapidly making these calculations in one's mind while playing the game of Craps is impossible because of the speed of the game, and thousands of possibilities. As an aid to this determination, I have devised a circular slide type of calculator for use in selecting those number combinations and progressive and regressive wager levels most advantageous to the player, and least advantageous to the house.

SUMMARY OF THE INVENTION

My invention resides in a circular calculator for selecting prudent progressive and regressive bets to be wagered on the various craps playing functions, according to a logical analysis and the cyclic probability inherent in the random process. The calculator includes a circular frame member or disc with a front face having a plurality of windows formed therein. Lying adjacent to the windows are found identifying indicia corresponding to the various playing functions: LINE: Bet; PLACE: Bet-Pays; DOWN: 1, 2; PRESS: 1, 1+L, 2, 2+L; ODDS: Bet-Pays; and Proper Line Bet.

The LINE window on the Craps Computer tells the Bettor what to bet on the front or pass line. The PLACE window tells the Bettor the correct amount to bet on the Place 6 and 8 and what the correct payoff should be. The windows under DOWN labelled 1 and 2 are used for resetting the computer to a lower betting level after losing a bet. The windows under PRESS labelled 1, 1+L, 2, 2+L are used for resetting the computer to a higher betting level as the bettor's bankroll increases.

The ODDS section of the computer is independent from the rest of the computer except for the LINE bet. The amount of free ODDS one is allowed to bet is determined by the line bet one has already made and the point which the shooter subsequently established. If the bettor decides to place an ODDS bet, the LINE bet should be taken from the ODDS section of the computer so the bettor can take full advantage of the possible payoff without having to increase his line bet after the point is established, thereby forfeiting some degree of advantage.

An indicator, labelled BANK, which is an abbreviation of the word Bankroll, is formed on the front surface of the stationary frame disc at one edge thereof. The indicator, as will be explained more fully below, is used to indicate the bettor's present and commited bankroll level.

The calculator also includes a circular slide member or disc, larger in diameter than the circular frame member and pivotally attached at its center to the center of the circular frame member. The circular slide disc has formed thereon a plurality of scales in adjacent relationship. The scales are composed of individual numbers and number groups, located at varying distances from the center of the slide disc.

On the rim of the slide disc, is the first of the scales. Since the frame disc is smaller in diameter than the slide disc, the first scale on the slide disc is completely visible in its entirety. This first scale represents the bettor's present Bankroll level. It starts at the $150.00 level and goes up by $50.00 increments to $1,000.00. By interpolation, the scale can be used to figure amounts from $15.00 to $1,000,000.00. Each number or number group on the rest of the scales has a width substantially equal to the width of the frame disc windows. The scales are divided into segments corresponding to the 12 windows on the front face of the frame disc. Each scale corresponds to a different craps playing function and shows different number patterns in each window depending upon alignment of the Bank indicator with the bankroll level indicia on the slide member. The spacing between an individual number or number group on the various scales and its corresponding indicia on the bankroll level scale is substantially equal to the arcuate distance between one whole number indicia and the next whole number indicia on the bankroll level scale. This arrangement requires that when the BANK indicator is aligned with one of the whole number indicia on the bankroll level scale of the slide disc, the appropriate number values for that bankroll level will appear in the frame disc windows corresponding to the 12 playing functions for which the computer may be used.

Figure 1:
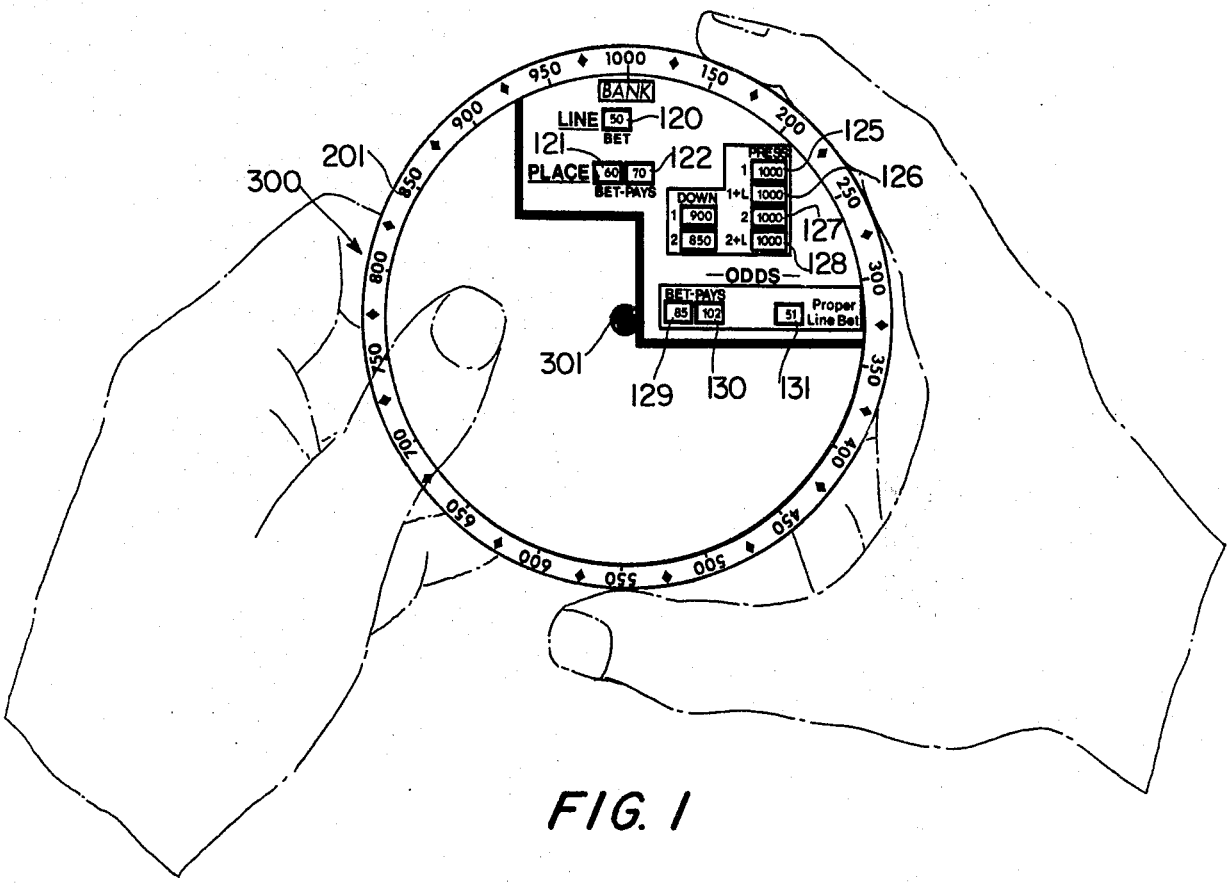
FIG. 1 is a plan view of an assembled computer of the present invention, illustrating its operation.

The calculator is illustrated in the hands of an operator in FIG. 1, the operator's hands being shown in phantom line. In use, the operator holds the frame disc 100 stationary with one thumb and uses the fingers of the other hand to rotate the slide disc to the desired location.

Figure 2B:
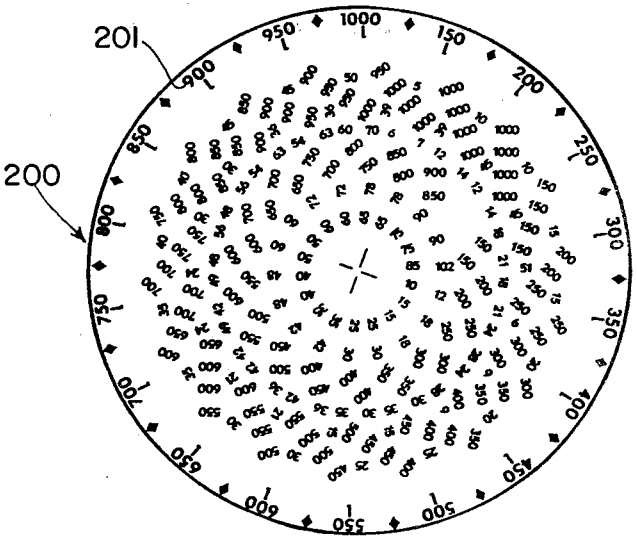
FIG. 2B is a plan view of the slide disc of the present invention.
Figure 2A:
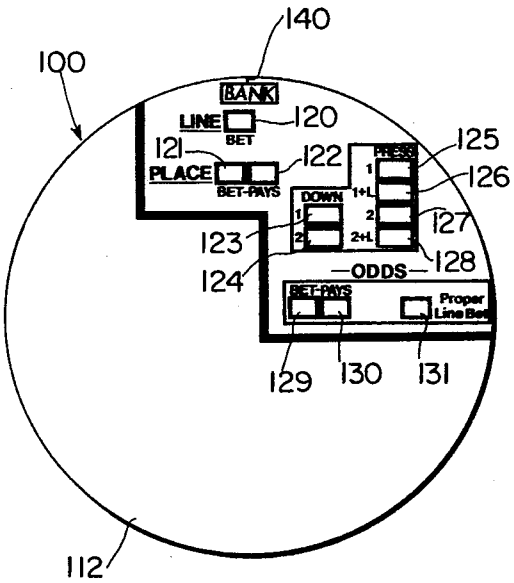
FIG. 2A is a plan view of the frame disc of the present invention.

FIG. 2A illustrates the frame member 100. The frame is preferably of circular configuration. The frame 100 includes a front face 112 in which has been cut a series of windows numbered 120–131. In the present showing illustrated, there is an actual series of slots cut into the frame 100. However, transparent windows in a plastic frame 100 would serve the same purpose. The words slot and windows are thus equivalent in this sense.

Lying next to each window, is a word in large letters which identifies the craps playing function associated with that window or window group. As indicated before, the LINE window 120, on the Craps Computer, tells a player what amount to bet on the pass line. It should be noted that beneath window 120, is the word BET which serves as a reminder to the player of what the digits in the window are for. There are two PLACE windows entitled Bet 121, and Pays 122. The PLACE windows tell the player the correct amount to bet on the Place 6 and Place 8 in order to take advantage of the proper payoff, and what the correct payoff should be. The windows under the heading DOWN are entitled DOWN 1, 123 and DOWN 2, 124. The windows under DOWN 1 and 2 are used for resetting the computer to a lower bankroll level. The windows under PRESS are labelled PRESS 1, 125; PRESS 1+L, 126, PRESS 2, 127 and PRESS 2+L, 128. These windows are used for resetting the craps computer to a higher bankroll level.

At the edge of the computer, directly above the LINE bet window 120, is found an indicator or pointer 140 entitled BANK. The Pointer is used to indicate the amount of cash the player has mentally commited to any particular session of play.

Windows under the heading ODDS are entitled ODDS: Bet-129, Pays-130 and Proper Line Bet-131. The ODDS section tells the player what to bet (in window 129) and what the proper payoff should be (window 130). When predetermining that an optional odds bet may want to be taken during play of a hand, and due to the payoff mathematics of the game, the bettor should take his line bet from the ODDS section of the computer window entitled Proper Line Bet 131.

FIG. 2 B illustrates circular slide 200 which makes up the second and final portion of the Craps Computer of the present invention. Circular slide 200 is slightly larger in diameter than frame 100. Slide disc 200 and frame disc 100 are rotatably attached at their mutual centers by any common means sufficient to hold the discs together yet allow them to rotate relatively to each other; here a grommet 301 is used as seen in FIG. 1. Thus, it may be seen that frame disc 100 and sliding disc 200 are co-axial. Printed or otherwise impressed on the sliding disc 200 are a plurality of scales positioned in relation to the center of the slide, and to each other. The first of such scales as shown in FIG. 2 B, is scale 201 formed at the periphery of the sliding frame member. The indicia on scale 201, indicates the bankroll level of the bettor in dollars. Because the sliding disc 200 is larger in diameter than the stationary disc 100, the numbers of scale 201 are visible at all times.

Except for scale 201, the center point of the individual numbers or number groups for any scale on sliding disc 200, is located a distance from the center of sliding disc 200 equal to the distance of the center point of the windows, in which the number or number groups are viewed, to the co-axial center of the two respective discs. i.e., frame disc 100 and sliding disc 200. The remainder of the scales on sliding disc 200 lie close to the center of the slide and are covered by frame disc 100 when the two parts of the calculator are joined together. The spacing of the indicia numbers on scale 201 is fixed to allow alignment of an indicia number with pointer 140 thereon and so thereby align the remainder of the scales on sliding disc 200 in the appropriate windows on the face 112 of the frame disc 100. This is shown in FIG. 1 wherein pointer 140 is aligned with number 1,000 on scale 201. Pointer 140 should be perfectly aligned with mark under 1000 on FIG. 1 even though it may have been off a hair on the cardboard prototype.

Figure 3:
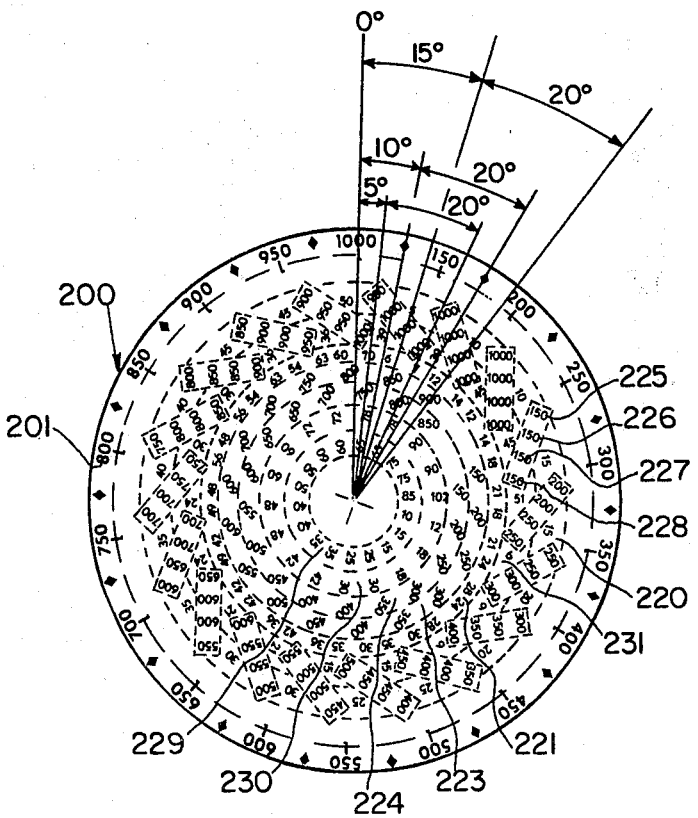
FIG. 3 shows the relationship of a radian line on the disc illustrated at 2B to the numerical scales on disc 2B.

Due to the rotational arrangement of the calculator, many of the scales have been placed at an angle to a radian line drawn from the center of sliding disc 200 so as to appear in the proper relationship in their respective windows. To assist in understanding the positioning of the various scales on sliding disc 200, the scales have been separated by phantom lines in FIG. 3. It should be understood that in the actual computer as used, such lines do not exist. The orientation of each scale on sliding disc 200 differs, depending upon the distance of the scale in question from the center of the circle and the position and orientation of the window in which the number or number group is supposed to appear. Starting from the center of slide 200, are found two adjacent circular scales 229 and 230 which appear in windows 129 and 130, respectively on the front surface 112 of frame 100. Scale 230 is exterior to scale 229. The vertical axis of the numbers in scales 229 and 230 are oriented perpendicularly to a radian line drawn from the center of sliding disc 200. Next away from the center of sliding disc 200 is found scale 224, the numbers of which appear in window 124 on the front surface of frame disc 100. The horizontal axis of the numbers on scale 224 is oriented so as to form a 130 degree obtuse angle relative to a radian line drawn from the center of sliding disc 200. Exterior to scale 224, is found scale 223. The numbers of scale 223 appear in window 123 on the front surface of frame disc 100. The horizontal axis of the numbers of scale 223 is oriented so as to form an obtuse angle of approximately 130 degrees relative to a radian line drawn from center of sliding disc 200. Exterior to scale 223, is located scale 221. The numerals on scale 221 are so arranged that they appear sequentially in windows 121 and 122 on frame disc 100. The vertical axis of the numbers found on scale 221 is oriented in parallel relationship to a radian line drawn from the center of sliding disc 200. Exterior to scale 221, is found scale 231, the numbers of which appear in window 131 on the front face 112 of the computer. The vertical axis of the numbers found on scale 231, is oriented in perpendicular relationship to a radian line drawn from the center of sliding disc 200. Additionally, it must be noted that the digits of scale 231 occur every 20 degrees only of the circumference of the circle. If the bankroll level of $1000.00 were considered to be the 0 point of the circumference of the circle, the first digit of scale 231 would appear at approximately the ten degree point, with the remaining numbers or number groups of the scale appearing at approximately 30 degrees, 50 degrees, 70 degrees, 90 degrees, and so on for the entire circumference. Thus, it may be seen that the numbers of scale 231 are so positioned as to appear in the proper windows of front face 112 when pointer 140 is properly aligned with the whole number indices on scale 201. Scale 225, 226, 227, and 228 are found adjacent to scale 231. Scale 225, 226, 227, and 228 appear in windows 125, 126, 127, and 128 respectively on the front face 112 of frame disc 100. The horizontal axis of the number groups in scales 125, 126, 127, and 128 is oriented so as to form an obtuse angle of approximately 150 degrees relative to a radian line drawn from the center of sliding disc 200. As with scale 231, the number of scales 225, 226, 227, and 228 are so positioned as to appear in the proper windows on front face 112 of frame disc 100 when a whole number indicia on scale 201 is properly aligned with pointer 140. Exterior to scale 231 is found scale 220. The numbers in scale 220 appear in window 120 on the front face 112 of frame disc 100. The vertical axis of the numbers found in scale 220 is oriented in parallel relationship to a radian line drawn from the center of sliding disc 200. Additionally, it must be noted that the digits of scale 220 occur only every 20 degrees of the circumference of the circle of sliding disc 200. If the bankroll level of $1000.00 were considered to be the zero point of the circumference, the first digit on scale 220 would appear at approximately the 15 degree point, with the remaining number or number groups appearing at 35 degrees, 55 degrees, and so on, for the remainder of the circumference.

FIG. 1 illustrates the operation of the calculator of the present invention at 300. As indicated, sliding disc 200 is rotatably attached to the center of frame disc 100 by center grommet 301. Indicator 140 is aligned with the indicia $1,000 on scale 201 to show the proper wagers for a bankroll level of $1,000. As may be seen in window 120, the LINE Bet should be $50.00, the PLACE bet, window 121, should be $60.00, and if the bettor wins, the house will pay $70.00, window 122. If the bettor is taking free ODDS, window 129 shows that he should bet $85.00 which, if the bettor wins, wll correctly pay $102.00, window 130. Window 131, shows the proper line bet to be $51.00. If the bettor loses one of his two place bets, the computer, under DOWN 1, window 123, would tell him to reset the bankroll level to $900, if he lost two place bets, the computer, in window 124 tells him to reset his computer to $850.00. Under the PRESS windows, if the Bettor places a single Place bet and wins, the computer would tell him under Press 1, window 125, to leave the indicator 140 set at $1,000. Similarly, if the bettor makes a single Line bet and a Place bet at this bankroll level and wins, the numbers in window 126 would tell him to leave the computer again set at $1,000. If the Bettor made and won two PLACE bets, window 127 under PRESS 2 would instruct him to leave the computer set at $1000. If the Bettor made and won two PLACE bets and a LINE bet, window 128 would tell him to leave the computer set at $1000. Of course it should be understood that at lower bankroll levels the specific number in the windows under PRESS 1, 1+L, 2 and 2+L will differ from the example given, and if the player desires to continue betting after reaching the $1000 level, he or she would revert to the interpolative feature and continue betting higher amounts.

I claim:

1. A dice throwing craps game computer for determining various positive and negative cyclic trends of probability of certain craps playing functions and appropriate progressive and regressive wagering techniques and values therein, comprising:

(A) a circular topmost frame disc, said frame disc including:

(A 1) a front face having formed therethrough, viewing window groupings corresponding to the major craps playing functions, said groupings including individual windows with identifying indicia lying adjacently;

(A 2) an indicator on the surface of said circular topmost frame disc at the edge thereof;

(B) a circular bottommost sliding disc, larger in diameter than the frame disc (A) and rotationally attached at its center to the center of said frame disc (A) and freely movable relative thereto, said sliding disc, having front and rear faces, said front face being contiguous to said frame disc (A), and having defined thereon a plurality of scales concentrically disposed relative to the center of said sliding disc (B);

(B 1) the first of said scales, having selected numerical designations positioned at the periphery of said sliding disc (B), the entirety of said first scale being at all times visible, (B 2) the remainder of said scales being positioned on the sliding disc so as to be selectively visible only, through the window of the frame disc (A), said scales, (B 2) being divided into sections corresponding in disposition to the superimposed viewing window groupings (A 1), each one of said scales (B 2) corresponding to a different craps playing function and showing different number patterns under each of said craps playing functions, whereby alignment of selected numerical designations on said first scale (B 1) on said sliding disc relative to indicator (A 2) will place a scale value from the remainder of said scales (B 2) in the said respective reviewing window groupings (A 1.).

2. The apparatus of claim 1 wherein said plural viewing windows are 12 in number.

3. The apparatus of claim 1 wherein the remainder of said scales (B 2) comprise eleven in number, (A) the first and second of said scales (B 2) being located adjacent the center of sliding disc B, the vertical axis of the numbers of said first and second scales being oriented perpendicularly to a radian line drawn from the center of said sliding disc B, (A 2) the third scale of said scales (B 2) being located exteriorly of said scale, the horizontal axis of the numbers of said third scale being oriented so as to form a negative obtuse angle relative to a radian line drawn from the center of sliding disc B, (A 3) the fourth scale of said scales (B 2) being located exteriorly to said third scale, the horizontal axis of the numbers on said fourth scale being oriented so as to form a negative obtuse angle relative to a radian line drawn from the center of sliding disc B, (A 4) the fifth scale of said scales (B 2) being located exteriorly to said fourth scale, the vertical axis of the numbers of said fifth scale being oriented in parallel relationship to a radian line drawn from the center of sliding disc B, (A 5) the sixth scale of said scale (B 2) being located exteriorly to said fifth scale, the vertical axis of the numbers of said sixth scale being oriented in perpendicular relationship to a radian line drawn from the center of sliding disc B, the numbers of said sixth scale being located angularly offset from a zero point on the circumference of sliding disc B, (A 6) the seventh scale of said scales (B 2) being located exteriorly to said sixth scale, the vertical axis of the numbers of the seventh scale being oriented in parallel relationship to a radian line drawn from the center of sliding disc B, the numbers of said seventh scale being also located angularly offset from a zero point on the circumference of sliding disc B, (A 7) the eighth, ninth, tenth and eleventh of said scales (B 2) being located in the interval between the respective number groups of the sixth and seventh scales, the eighth scale being located exteriorly of the fifth scale, the ninth scale being located exteriorly of the eighth scale, the tenth scale being located exteriorly of the ninth scale, the eleventh scale being located exteriorly of the tenth scale, the horizontal axis of the respective number groups in the eighth, ninth and tenth and eleventh scale being oriented so as to each form an obtuse negative angle relative to a radian line drawn from the center of sliding disc B, the first number group of said eighth scale being offset angularly from a zero point on the circumference of sliding disc B, the first number group of said ninth scale being offset angularly from a zero point on the circumference of sliding disc B, the first number group of said tenth scale being offset angularly from a zero point on the circumference of sliding disc B and the first number group of said eleventh scale being offset angularly from the zero point on the circumference of sliding disc B.

4. The apparatus of claim 2, wherein the remainder of said scales (B 2) comprise eleven in number, (A) the first and second of said scales (B 2) being located adjacent the center of sliding disc B, the vertical axis of the numbers of said first and second scales being oriented perpendicularly to a radian line drawn from the center of said sliding disc B, (A 2) the third scale of said scales (B 2) being located exteriorly of said scale, the horizontal axis of the numbers of said third scale being oriented so as to form a negative obtuse angle relative to a radian line drawn from the center of sliding disc B, (A 3) the fourth scale of said scales (B 2) being located exteriorly to said third scale, the horizontal axis of the numbers on said fourth scale being oriented so as to form a negative obtuse angle relative to a radian line drawn from the center of sliding disc B, (A 4) the fifth scale of said scales (B 2) being located exteriorly to said fourth scale, the vertical axis of the numbers of said fifth scale being oriented in parallel relationship to a radian line drawn from the center of sliding disc B, (A 5) the sixth scale of said scale (B 2) being located exteriorly to said fifth scale, the vertical axis of the numbers of said sixth scale being oriented in perpendicular relationship to a radian line drawn from the center of sliding disc B, the numbers of said sixth scale being located angularly offset from a zero point on the circumference of sliding disc B, (A 6) the seventh scale of said scales (B 2) being located exteriorly to said sixth scale, the vertical axis of the numbers of the seventh scale being oriented in parallel relationship to a radian line drawn from the center of sliding disc B, the numbers of said seventh scale being also located angularly offset from a zero point on the circumference of sliding disc B, (A 7) the eighth, ninth, tenth and eleventh of said scales (B 2) being located in the interval between the respective number groups of the sixth and seventh scales, the eighth scale being located exteriorly of the fifth scale, the ninth scale being located exteriorly of the eighth scale, the tenth scale being located exteriorly of the ninth scale, the eleventh scale being located exteriorly of the tenth scale, the horizontal axis of the respective number groups in the eighth, ninth and tenth and eleventh scale being oriented so as to each form an obtuse negative angle relative to a radian line drawn from the center of sliding disc B, the first number group of said eighth scale being offset angularly from a zero point on the circumference of sliding disc B, the first number group of said ninth scale being offset angularly from a zero point on the circumference of sliding disc B, the first number group of said tenth scale being offset angularly from a zero point on the circumference of sliding disc B and the first number group of said eleventh scale being offset angularly from the zero point on the circumference of sliding disc B.

* * * * *